US006128883A

United States Patent [19]

Hatzinikolas

[11] Patent Number: 6,128,883

[45] Date of Patent: Oct. 10, 2000

[54] BRICK ANCHOR SYSTEM

[75] Inventor: Michael Hatzinikolas, Edmonton, Canada

[73] Assignee: Lathico Industries, Edmonton, Canada

[21] Appl. No.: 09/399,315

[22] Filed: Sep. 20, 1999

[51] Int. Cl.[7] ..... E04B 1/38

[52] U.S. Cl. ..... 52/698; 52/378; 52/379; 52/508; 52/513; 52/702; 52/714

[58] Field of Search ..... 52/378, 379, 702, 52/698, 714, 508, 513

[56] References Cited

U.S. PATENT DOCUMENTS 2,363,156 11/1944 Sinner et al. ..... 52/378
3,234,702 2/1966 Zibell ..... 52/379
3,450,427 6/1969 Fischer ..... 52/378
5,619,834 4/1997 Chen ..... 52/698

*Primary Examiner*—Carl D. Friedman
*Assistant Examiner*—Christy M. Syres
*Attorney, Agent, or Firm*—Murray E. Thrift; Adrian D. Battison; Michael R. Williams

[57] ABSTRACT

An anchoring system for anchoring bricks to a wall includes an anchoring bracket which is mounted adjacent to the wall and a receiving slot in the bracket for receiving a brick support therein. The anchoring bracket is secured to the wall using threaded fasteners. The brick support includes a supporting flange and a mounting flange mounted in an L-shaped orientation. The receiving slot supports the mounting flange therein such that the supporting flange extends laterally outward from the wall for supporting the bricks thereon.

13 Claims, 3 Drawing Sheets

BRICK ANCHOR SYSTEM

FIELD OF THE INVENTION

This invention relates to an anchoring systems for bricks and more particularly to an anchor system for anchoring a brick support to a wall.

BACKGROUND

When mounting bricks on the face of a wall structure, it is common to support the first row of bricks on a steel support which extends laterally outward from the wall structure. The steel support must first be mounted on the wall before any brick laying can commence. This is commonly accomplished by welding the steel support to a steel anchoring system embedded in the wall. Welding however is an expensive and time consuming task requiring specialised labour.

SUMMARY

According to the present invention there is provided a brick anchor system for supporting bricks to be mounted on a wall wherein the brick anchor system comprises:

an anchoring bracket extending outwards from the wall and including a receiving slot therein;

threaded fastening means for threadably securing the anchoring bracket to the wall; and a support element comprising:

a mounting flange for engaging into the receiving slot in the anchoring bracket; and a supporting flange connected to the mounting flange and extending laterally away from the wall for supporting bricks thereon.

In this arrangement the relative location of the anchoring brackets remains adjustable as the brick support is mounted thereon by first loosely fastening the threaded fastening means for accommodating irregularities in the wall or misalignment between adjacent anchoring brackets. Once the brick support is then secured to the wall by tightening the threaded fastening means, further displacement of the anchoring brackets is inhibited by the engagement of the anchoring element with the wall and with the support element.

The threaded fastening means may comprise at least one bolt anchor embedded into the wall such that a threaded bolt may be inserted through a respective aperture in the anchoring bracket and secured within each of the bolt anchors in the wall.

Alternatively, the threaded fastening means may comprise at least one bolt embedded into the wall such that a head of the bolt is anchored within the wall and a threaded portion of the bolt extends out of the wall for insertion through a respective aperture in the anchoring bracket such that a nut may be fastened onto the threaded portion of each bolt for securing the anchoring bracket to the wall.

For independently adjusting the positioning of each bracket relative to each other, there may be provided:

a backing plate mounted adjacent to the wall; and a supporting plate spaced apart from the backing plate;

wherein a lower slot extends upwards from a bottom edge of the anchoring bracket for slidably engaging the lower slot over a top edge of the supporting plate such that a portion of the anchoring bracket is engaged between the backing plate and the supporting plate; and wherein the threaded fastening means secures the backing plate and the supporting plate to the wall.

Alternatively, there may be provided an elongate fastener slot in the anchoring bracket for receiving the fastening means therethrough such that the bracket can be fastened to the wall at numerous positions relative to the wall corresponding to different positions of the fastener within the slot. The elongate fastener slot preferably extends in an inclined direction which is angularly offset from a vertical axis extending across the anchoring bracket.

The receiving slot may comprise a slot extending downwardly from a top edge of the anchoring bracket for slidably engaging the mounting flange of the brick support therein.

There may be provided a recessed channel in a forward end of the support member defining a shoulder for supporting the supporting flange of the brick support thereon such that the supporting flange extends laterally outward from the wall. When a recessed channel is provided, the receiving slot preferably extends upward from a rearward edge of the recessed channel for receiving the mounting flange of the brick support therein such that the supporting flange is secured in a lateral orientation on the shoulder of the bracket.

Preferably there is provided at least two anchoring brackets mounting the support element thereon, the anchoring brackets each having an elongate fastener slot therein for receiving the threaded fastening means therethrough, the fastener slots being angularly offset from vertical in opposing directions.

There may be provided a shim plate mounted between the anchoring bracket and the wall such that a spacing between the support element and the wall is adjustable by replacing the shim plate with an additional shim plate having a different thickness.

BRIEF DESCRIPTION OF THE DRAWINGS

In the accompanying drawings, which illustrate exemplary embodiments of the present invention.

DETAILED DESCRIPTION

Figure 1:
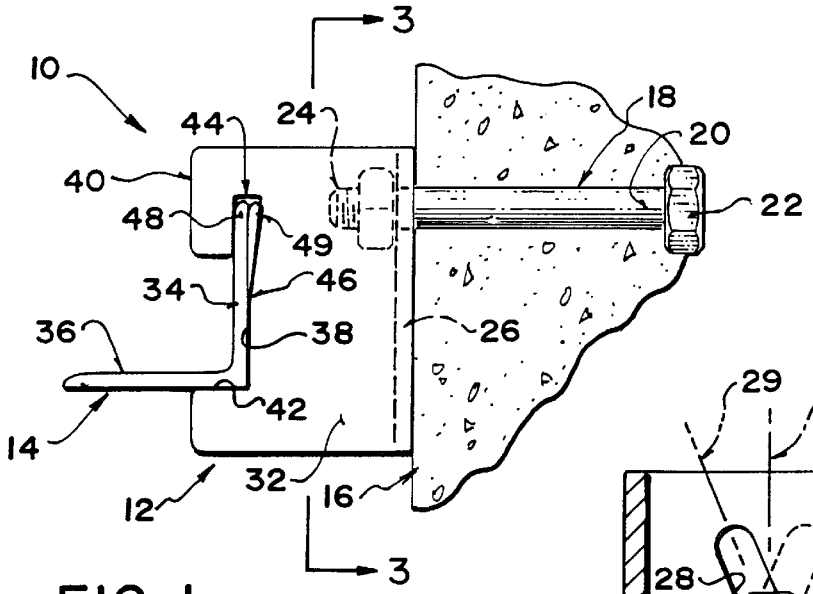
FIG. 1 is a side elevational view of the anchoring bracket.
Figure 3:
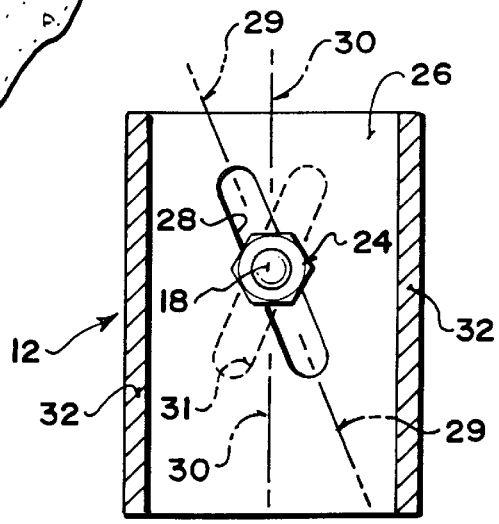
FIG. 3 is a cross sectional view along the line 3—3 of FIG. 1.
Figure 2:
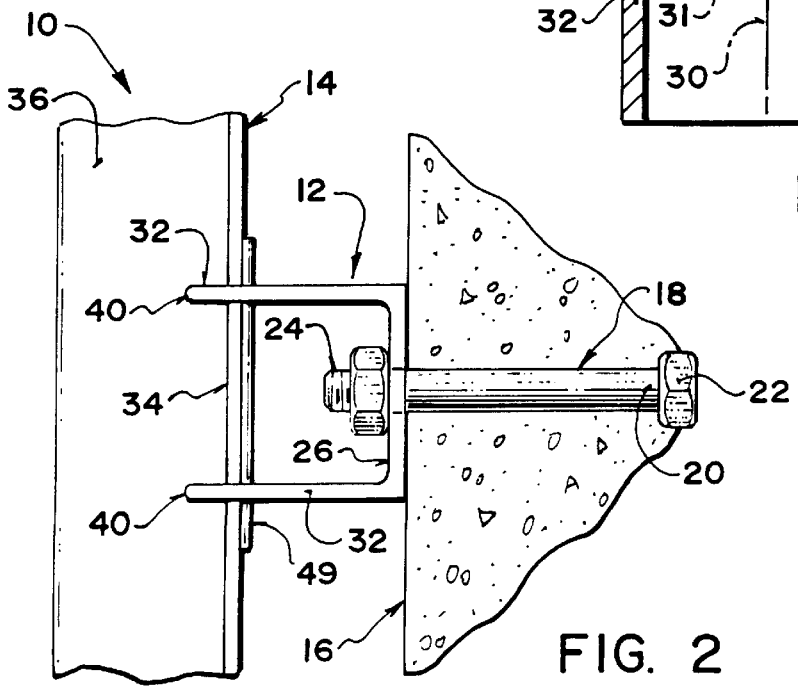
FIG. 2 is a top plan view of the anchoring bracket.

Referring to the FIGS. 1 through 3 initially there is illustrated a first embodiment of a brick anchoring system generally indicated by reference numeral 10. The brick anchoring system 10 includes a plurality of anchoring brackets 12 which are arranged to anchor a brick support 14 to a wall structure 16, each anchoring bracket using a bolt 18 for securement to the wall.

A first end 20 of each bolt 18 having a head 22 thereon, is embedded into the wall structure. The threaded end 24 of the bolt extends laterally outward past a surface of the wall structure.

The anchoring bracket 12 is a steel channel which is generally U-shaped in cross section. The base of the U-shaped channel is formed by a rear plate 26 which is generally rectangular in shape.

A fastener slot 28 is formed in the rear plate 26 for receiving the threaded end of the bolt. Threading a nut onto the bolt will engage the rear plate adjacent to the wall and secure the anchoring bracket in place.

The fastener slot 28 is an elongate aperture in the rear plate which extends along an inclined axis 29 which is angularly offset from a vertical axis 30 extending across the plate member in a left hand configuration shown in FIG. 3. The inclined axis 29 is offset 22.5 degrees from the vertical axis 30. Alternatively, in a right hand configuration the fastener slot appears as indicated by reference numeral 31, being offset 22.5 degrees from the vertical axis in the opposite direction. The upright plate can thus be fastened to the wall at numerous locations relative to the wall corresponding to different positions of the bolt within the slot.

A pair of side plates 32 extend from respective sides of the rear plate 26 in a direction away from the wall to form the sides of the U-shaped channel. The side plates are generally rectangular in shape and lie in respective vertical planes.

The side plates 32 are arranged to support the brick support 14 thereon. The brick support 14 includes a mounting flange 34 which engages the anchoring bracket 12 and a supporting flange 36 which is arranged to support bricks thereon. The mounting flange 34 and the supporting flange are mounted at right angles to form an L-shaped channel made of steel.

The side plates 32 each include a recessed channel 38 in a forward edge 40 thereof. The recessed channel 38 forms a shoulder 42 at a bottom end for supporting the supporting flange 36 of the brick support thereon such that the supporting flange extends laterally outward from the wall.

A receiving slot 44 extends upward from a rearward edge 46 at a top end of the recessed channel 38. The receiving slot 44 slidably receives an edge portion 48 of the mounting flange 34 therein such that the brick support 14 remains secured to the anchoring bracket 12 when the weight of numerous bricks are stacked on the supporting flange 36. The rearward edge 46 along the receiving slot 44 extends upward at a slight rearward incline for accommodating the edge portion 48 of the mounting flange as it is inserted therein. A wedge shaped shim 49 is inserted between the mounting flange 34 and the rearward edge 46 as required to tightly engage the brick support on the anchoring bracket.

In use, a plurality of the anchoring brackets are horizontally spaced across a wall using a chalk line and a measuring tape. The anchoring brackets are mounted in an alternating arrangement from the left hand configuration with the fastener slot appearing as shown by reference numeral 28 to the right hand configuration with the fastener slot appearing as shown by reference numeral 31. The brackets are mounted along the wall such that each anchoring bracket having a left hand orientation is adjacent an anchoring bracket having a right hand orientation.

A brick support in the form of a standard size shelf angle is mounted across the wall on the anchoring brackets. The anchoring brackets are first bolted to the wall by securing the bolts loosely by hand. The brick support is then mounted on the anchoring brackets by inserting a edge portion 48 of the mounting flange 34 upward into the receiving slot 44 of each anchoring bracket at an incline and then by pivoting the supporting flange 36 inward until the mounting flange engages the rearward edge 46 of the recessed channel 38. The rearward edge 46 prevents the brick support from being further pivoted within the recessed channel as the weight of the bricks is applied to the brick support. The bolts are then tightened snugly and the wedge shaped shims 49 are inserted as required.

Until the nuts on the respective bolts are tightened, the relative height of each anchoring bracket is adjustable by sliding the anchoring bracket laterally along the brick support as the anchoring bracket is moved upward or downward relative to the bolt extending from the wall. This lateral movement of the anchoring bracket relative to the brick support with the adjustment in height is due to the inclination of the fastener slot from the vertical.

Once the nuts are tightened on the bolts the brick support is secured to the wall structure and bricks may be supported thereon. The inclination of the fastener slot from the vertical acts to inhibit vertical displacement of the anchoring bracket along the mounting bolt through the resistance of the lateral movement of the anchoring bracket along the brick support. Having anchoring brackets of opposing orientation mounted adjacent to each other further restricts the entire brick anchor system from shifting positions relative to the wall once the bolts are tightened.

In this arrangement the relative location of the anchoring brackets remains adjustable as the brick support is mounted thereon for accommodating irregularities in the wall or misalignment between adjacent anchoring brackets. Once the brick support is then securely fastened to the wall further vertical displacement of the anchoring brackets is inhibited by the resistance of lateral movement of the anchoring brackets relative to the brick support due to the arrangement of the fastener slot.

Figure 4:
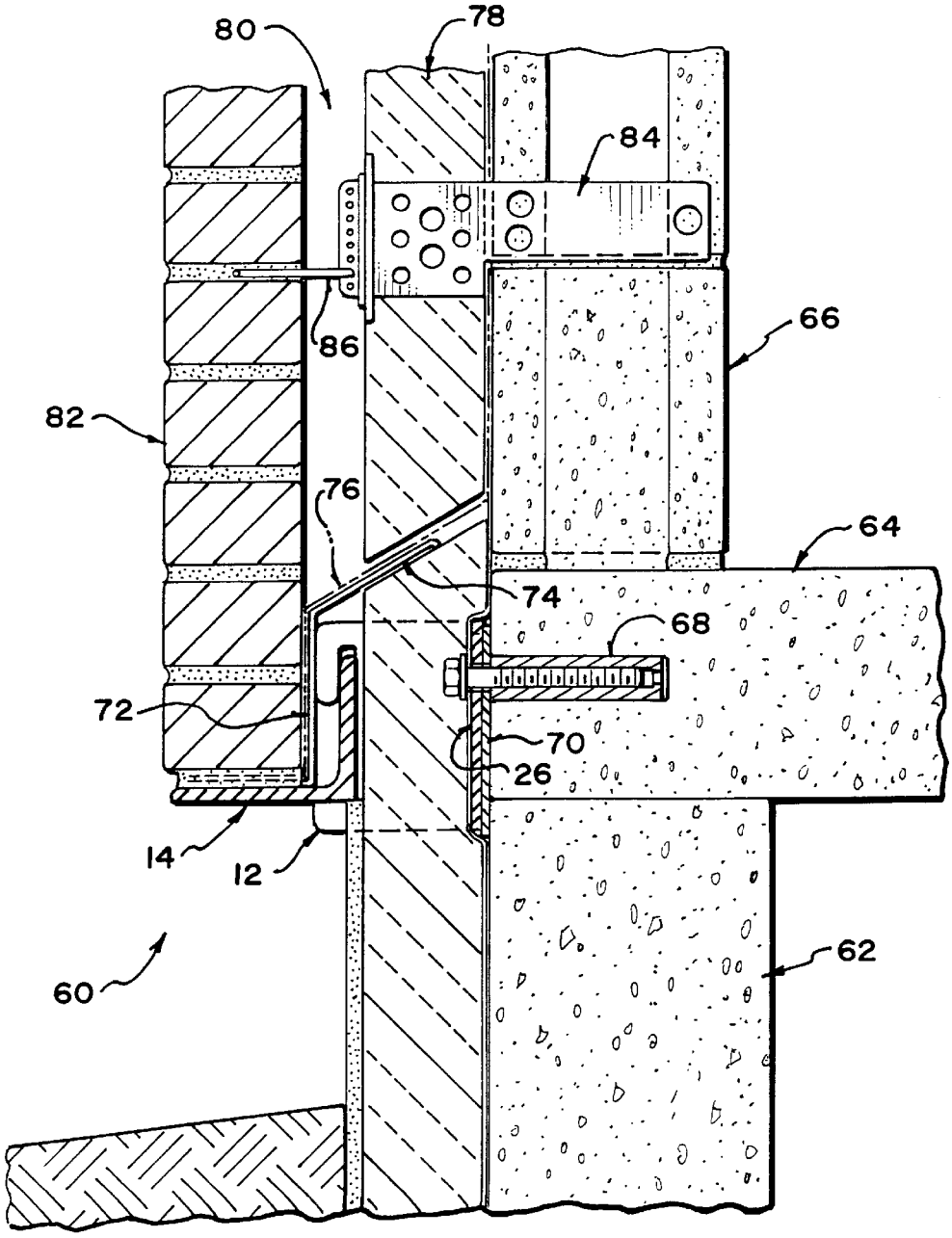
FIG. 4 is a side elevational view of the brick anchor system of FIG. 1 showing the anchoring bracket mounted with bolt anchors embedded in the wall.

A wall structure 60 using the brick anchor system 10 is illustrated in FIG. 4 wherein the bolts for mounting the anchoring brackets have not been embedded into the concrete as shown in FIG. 1. The wall structure 60 includes a foundation 62 supporting a reinforced concrete slab 64 thereon. A plurality of concrete blocks 66 form an upright portion of the wall structure. The anchoring brackets 12 are mounted horizontally spaced along the outer face of the wall structure using bolt anchors 68 which are received in bores drilled into the concrete slab 64.

The use of embedded bolts for mounting the anchoring brackets as shown in FIGS. 1 to 3 operates similarly to the use of bolts which are received in embedded bolt anchors. Instead of tightening the nuts on the ends of the bolts for securing the anchoring brackets, the bolts are simply tightened into their respective anchors which are received in bores in the concrete wall.

A shim plate 70 which is substantially similar in size to the anchoring bracket, mounts between each anchoring bracket and the outer face of the wall for evenly engaging the concrete surface and for spacing each anchoring bracket from the wall as desired to accommodate for irregularities in the outer face of the wall.

The brick support 14 is secured to the anchoring brackets 12 as described previously. A continuous metal flashing 72 is supported on the brick support and connects to a continuous flexible flashing 74 which extends over the brick supports and connects to a vapour barrier membrane 76 on the outer face of the wall. Sheets of rigid insulation 78 are mounted over top of the membrane 76 on the outer face of the wall. The anchor system allows cavity insulation to be continuous behind the brick support which dramatically reduces the effect of thermal bridging. The rigid insulation 78 is of a thickness which allows an air space 80 to be incorporated into the wall structure between the insulation and the brick facing 82 mounted on the brick support. Concrete block shear connectors 84 are mounted within wall of concrete blocks and mounts wall ties 86 thereon for connection to the brick facing 82.

The anchoring brackets 12 are made in a variety of sizes each corresponding to a desired thickness of the rigid insulation 78 and air space 80 located between the outer face of the wall and the brick facing. In this arrangement, a standard size of brick support 14 may be used regardless of the spacing between the brick facing and the face of the wall desired for insulation.

The anchor system can also be used for supporting masonry veneer, thin granite veneer, large stone panels or pre-cast concrete in place of the bricks. Once the brick support 14 is secured to the wall and properly shimmed, a significant load can be mounted on the brick support.

Figure 5:
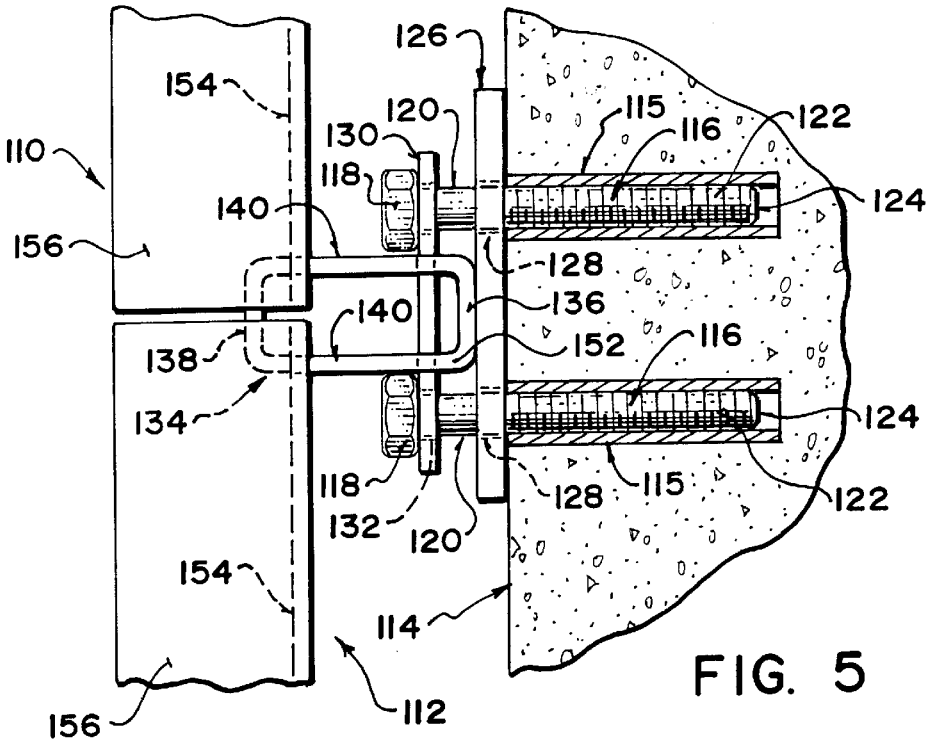
FIG. 5 is a top plan view of an alternative embodiment of the brick anchor system.
Figure 6:
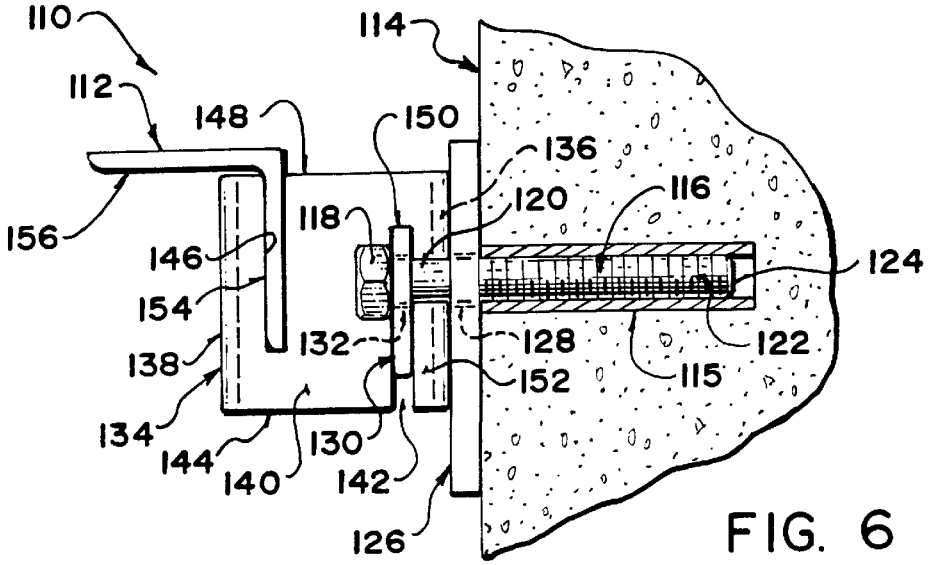
FIG. 6 is a side elevation view of the brick anchor system of FIG. 5.

Referring to FIGS. 5 and 6, there is illustrated a further embodiment of the anchor system generally indicated by the number 110. The anchor system 110 is for anchoring a brick support 112 to a wall 114.

A pair of bolt anchors 115 are embedded into the wall for receiving a pair of respective bolts 116. The bolts 116 have a head 118 on a first end 120 and a threaded portion 122 on a second end 124. The second ends 124 of the bolts are threaded into the anchors 115 when the anchor system is mounted on the wall.

A backing plate 126 having a pair of first apertures 128 is mounted against the wall 114 such that the bolts 116 are inserted through the respective first apertures 128. A supporting plate 130 having a pair of second apertures 132 is mounted onto the bolts 116 such that the bolts 116 are inserted through the respective second apertures 132.

An anchoring bracket in the form of an upright sleeve 134 of rectangular cross-section is mounted onto the supporting plate 130. The sleeve 134 has a first end 136 adjacent to the backing plate 126, a second end 138 spaced outwardly from the backing plate and a pair of sides 140 extending from the first end to the second end. Each side 140 includes a lower slot 142 extending upwards from a bottom edge 144 of the sleeve 134 adjacent the first end 136 and a receiving slot 146 extending downwards from a top edge 148 of the sleeve 134 near the second end 138. The lower slots 142 are slidably engaged over a top end 150 of the supporting plate 130 for mounting the sleeve 134 on the supporting plate. An engaged portion 152 of the sleeve is inserted between the supporting plate 130 and the backing plate 126.

The brick support 112 includes a mounting flange 154 and a supporting flange 156 which are connected such that the brick support 112 has an L-shaped cross section. The mounting flange 154 of the brick support 112 extends downwards for slidably engaging into the receiving slots 146 of the sleeve 134. The supporting flange 156 extends laterally away from the wall 114 being partially supported on the top end of the sleeve 134 for supporting the bricks thereon.

In this arrangement, tightening the bolts 116 into the respective sleeves 115 secures the engaged portion 152 of the sleeve between the plates 126 and 130 and fixes the anchoring bracket in place. In use a plurality of the anchoring brackets are mounted across a wall for supporting a brick support thereon. The bolts are first loosely threaded into the respective bolt sleeves as the brick support is positioned. The anchoring brackets are thus free to be displaced in an upward and downward direction or a side to side direction by sliding the lower slots along the supporting plate for accommodating irregularities in the wall or misalignments between respective anchoring brackets on the wall. Once the brick support is adequately positioned, the bolts are tightened and the engaged portion of the sleeve remains engaged between the plates 126 and 130 in a fixed relationship such that bricks may be supported on the brick support.

While two embodiments of the present invention have been described in the foregoing, it is to be understood that other embodiments are possible within the scope of the invention. The invention is to be considered limited solely by the scope of the appended claims.

What is claimed is:

1. A brick anchor system adapted to support bricks on a wall wherein the brick anchor system comprises:

a plurality of anchoring brackets, each anchoring bracket comprising a base plate having at least one mounting aperture therein and at least one plate member extending outwards from the base member including a receiving slot therein spaced from the base member, the brackets being adapted to be mounted on the wall such that the respective base plates are located adjacent to the wall with the respective receiving slots being oriented to extend in a substantially vertical direction spaced outwardly from the wall;

a threaded fastener associated with each anchoring bracket, the threaded fasteners being arranged to be inserted through the respective mounting apertures and mounted into the wall for threadably securing the anchoring brackets to the wall; and a support element arranged to be supported on the plurality of anchoring brackets, the support element comprising:

a mounting flange for engaging into the receiving slots in the respective anchoring brackets; and a supporting flange connected to the mounting flange at a substantially right angle thereto;

whereby the supporting flange extends substantially horizontally outward from the anchoring brackets when the mounting flange is received within the respective receiving slots of the anchoring brackets mounted on the wall for supporting bricks thereon.

2. The brick anchor system of claim 1 wherein the threaded fasteners each comprise a bolt anchor embedded into the wall and a threaded bolt arranged to be inserted through the respective aperture in the respective anchoring bracket for securement within the bolt anchor in the wall.

3. The brick anchor system of claim 1 wherein the threaded fasteners each comprise a bolt embedded into the wall such that a head of the bolt is anchored within the wall and a threaded portion of the bolt extends out of the wall for insertion through the respective aperture in the respective anchoring bracket and a nut arranged to be fastened onto the threaded portion of the bolt for securing the respective anchoring bracket to the wall.

4. A brick anchor system adapted to support bricks on a wall wherein the brick anchor system comprises:

a backing plate arranged to be mounted adjacent to the wall;

a supporting plate arranged to be mounted spaced apart from the backing plate;

an anchoring bracket arranged to be supported on the supporting plate wherein the anchoring bracket includes a lower slot which extends upwards from a bottom edge of the anchoring bracket for slidably engaging the lower slot over a top edge of the supporting plate such that a portion of the anchoring bracket is engaged between the backing plate and the supporting plate and a receiving slot spaced from the lower slot;

threaded fastening means for threadably securing the backing plate and the supporting plate to the wall; and a support element comprising:

a mounting flange for engaging into the receiving slot in the anchoring bracket; and a supporting flange connected to the mounting flange and being arranged to extend laterally outward from the wall when the anchoring bracket is mounted on the wall for supporting bricks thereon.

5. The brick anchor system of claim 1 wherein the receiving slot comprises a slot extending downwardly from a top end of the anchoring bracket for slidably engaging the mounting flange of the brick support therein.

6. The brick anchor system of claim 1 wherein each mounting aperture comprises an elongate fastener slot in the respective anchoring bracket for receiving the respective fastener therethrough such that the respective bracket can be fastened to the wall at numerous positions relative to the wall corresponding to different positions of the fastener within the slot.

7. The anchoring bracket according to claim 6 wherein the elongate fastener slot extends in an inclined direction which is angularly offset from a vertical axis extending across the base member.

8. The anchoring bracket according to claim 1 wherein there is provided a shoulder on each anchoring bracket extending substantially horizontally outward from the respective receiving slot when the anchoring brackets are mounted on the wall for supporting the supporting flange of the brick support thereon such that the supporting flange extends laterally outward from the wall.

9. The anchoring bracket according to claim 8 wherein there is provided a recessed channel in a forward end of each anchoring bracket defining the shoulder thereof and wherein the receiving slot extends upward from a rearward edge of the recessed channel when the anchoring brackets are mounted on the wall for receiving the mounting flange of the support element therein such that the supporting flange is secured in a lateral orientation on the shoulder of the bracket.

10. The anchoring bracket according to claim 1 wherein each mounting aperture comprises an elongate fastener slot which extends across the base member of the respective bracket in an inclined direction which is angularly offset from vertical for receiving the respective threaded fastener therethrough, the fastener slots of adjacent pairs of the anchoring brackets being angularly offset from vertical in opposing directions.

11. The anchoring bracket according to claim 1 wherein there is provided a shim plate arranged to be mounted between each anchoring bracket and the wall such that a spacing adjacent each anchoring bracket between the support element and the wall is adjustable by replacing the shim plate with an additional shim plate having a different thickness.

12. A brick anchor system adapted to support bricks on a wall wherein the brick anchor system comprises:

a plurality of anchoring brackets arranged to be mounted spaced apart along the wall, each having at least one mounting aperture arranged to be located adjacent the wall and a receiving slot spaced outwardly therefrom, the mounting aperture comprising an elongate fastener slot which extends in an inclined direction angularly offset from a vertical axis across the anchoring bracket;

threaded fastening means for threadably securing the anchoring brackets to the wall; and a support element comprising:

a mounting flange for engaging into the receiving slots in the respective anchoring brackets; and a supporting flange connected to the mounting flange to extend laterally outward from the wall for supporting bricks thereon.

13. The anchoring bracket according to claim 12 wherein the fastener slots of adjacent anchoring brackets are angularly offset from vertical in opposing directions.

* * * * *